US005399215A

United States Patent [19]

Blot et al.

[11] Patent Number: 5,399,215

[45] Date of Patent: Mar. 21, 1995

[54] METHOD OF MANUFACTURING ASSEMBLIES COMPOSED OF TWO BONDED PARTS

[75] Inventors: Philippe Y. A. Blot, Nantes; Frédéric A. H. Leroy, Le Havre; Didier S. Vigneron, Bolbec, all of France

[73] Assignees: Societe Hispano-Suiza, Saint Cloud Cedex; Societe ACB, Paris, both of France

[21] Appl. No.: 107,370

[22] Filed: Aug. 17, 1993

[30] Foreign Application Priority Data

Aug. 19, 1992 [FR] France ..... 92 10123

[51] Int. Cl.[6] ..... B32B 31/20

[52] U.S. Cl. ..... 156/210; 156/242; 156/245; 156/285; 156/292; 264/511; 264/545

[58] Field of Search ..... 156/210, 242, 245, 285, 156/292, 470, 471, 472, 473; 264/511, 544, 545

[56] References Cited

U.S. PATENT DOCUMENTS

| | | | |
|---|---|---|---|
| 2,371,847 | 3/1945 | Saunders et al. | 156/292 |
| 2,670,501 | 3/1954 | Michiels | 156/210 |
| 3,026,231 | 3/1962 | Chavannes | 156/210 |
| 3,124,807 | 3/1964 | Frenkel et al. | 264/545 |
| 3,935,358 | 1/1976 | Convers et al. | 156/245 |
| 3,950,204 | 4/1976 | Williams | 156/285 |
| 4,192,701 | 3/1980 | Martin et al. | 156/285 |
| 4,457,797 | 7/1984 | Hatchadoorian et al. | 156/245 |
| 4,980,010 | 12/1990 | Ellis et al. | 156/292 |

FOREIGN PATENT DOCUMENTS

| | | |
|---|---|---|
| 0110311 | 6/1984 | European Pat. Off. . |
| 1.524.550 | 5/1968 | France . |
| 2304438 | 10/1976 | France . |
| 2374109 | 7/1978 | France . |
| 2487705 | 2/1982 | France . |
| 2552500 | 3/1985 | France . |

*Primary Examiner*—Caleb Weston

*Attorney, Agent, or Firm*—Oblon, Spivak, McClelland, Maier, & Neustadt

[57] ABSTRACT

A method of manufacturing an assembly composed of two shaped and bonded parts in which the two parts to be shaped and bonded are placed on a header and die of a press, an adhesive is applied to at least one of the facing surfaces of the parts, the space between the header and the die is pressurized so that the parts are hot-formed to the shapes of the header and the die, and the header and die are then moved towards each other to press and bond the parts together.

6 Claims, 2 Drawing Sheets

METHOD OF MANUFACTURING ASSEMBLIES COMPOSED OF TWO BONDED PARTS

BACKGROUND OF THE INVENTION

1. Field of the invention

The invention relates to a method of manufacturing assemblies composed of two bonded parts and which includes a forming phase, 2. Summary of the prior art The method generally used up to now consists of separately hot-forming the two parts which make up the assembly under deformation conditions known as superplastic, in which great elongation is possible. The two parts are then bonded together by interposing a layer of epoxide between their surfaces which come into contact, and then placing them in an autoclave chamber in which pressure is applied in order to compress the parts together at sufficient temperature to transform the layer of epoxide into an adhesive.

Apart from the inconvenience of having to use successive pieces of equipment, this method is also disadvantageous when the assembly is a panel stiffened by hollow ribs produced by deforming one of the parts, since the pressure necessary for bonding tends to crush the ribs. To avoid this the rib cavities have to be filled manually with an crush-resistant material, such as a honeycomb structure.

Another technique for joining two parts by compression avoids the use of an adhesive by relying on the compression to cause diffusion of the material at the mating surfaces of the assembled parts. Reference may be made to French patents 2 304 438 and 2 552 500 for a description of these techniques. In all the examples known to applicants, assembly precedes the forming of the whole and, furthermore, diffusion welding is not applicable to the aluminium alloys which are an important application of the present invention.

Finally, French patent 2 374 109 describes the pressing of a coating on an airplane wing by means of balloons filled with air in order to give it the required shape, followed by demounting and the application of an adhesive layer, after which the assembly can be carried out. This process requires numerous manual operations and, generally, the interposition of an intermediate layer at the time of shaping in order to avoid any adhesion and to give the correct shape. It is designed for large parts in relatively small numbers.

SUMMARY OF THE INVENTION

An essential object of the invention is to provide a very convenient method of producing an assembly composed of two bonded parts in which, in particular, it is unnecessary to demount the parts before obtaining the finished assembly.

To this end, according to the invention there is provided a method of manufacturing an assembly composed of two bonded parts, comprising the steps of:

a) providing a press having two members defining a header and a die which are movable towards and away from each other, at least one of said press members having cavities for shaping one of said parts;

b) placing said two parts from which said assembly is to be formed on said press members, one part on said header and the other part on said die;

c) placing a layer of adhesive on at least a portion of the surface of at least one of said two parts facing the other part;

d) applying pressure between said header and said die whereby said part on said at least one member having said cavities is deformed into said cavities to shape said part; and e) moving said header and said die towards each other to press said two parts against each other whereby said parts are bonded together by said adhesive.

The assembly is thus produced almost without any manual operations and without changing tools. The parts may often be hot-formed, at a temperature creating more or less pronounced superplasticity conditions according to need, that is, according to the amount of deformation required.

A detailed description of a preferred embodiment of the invention, given by way of example only, follows with reference to the attached drawings.

DESCRIPTION OF THE PREFERRED EMBODIMENT

Figure 1:
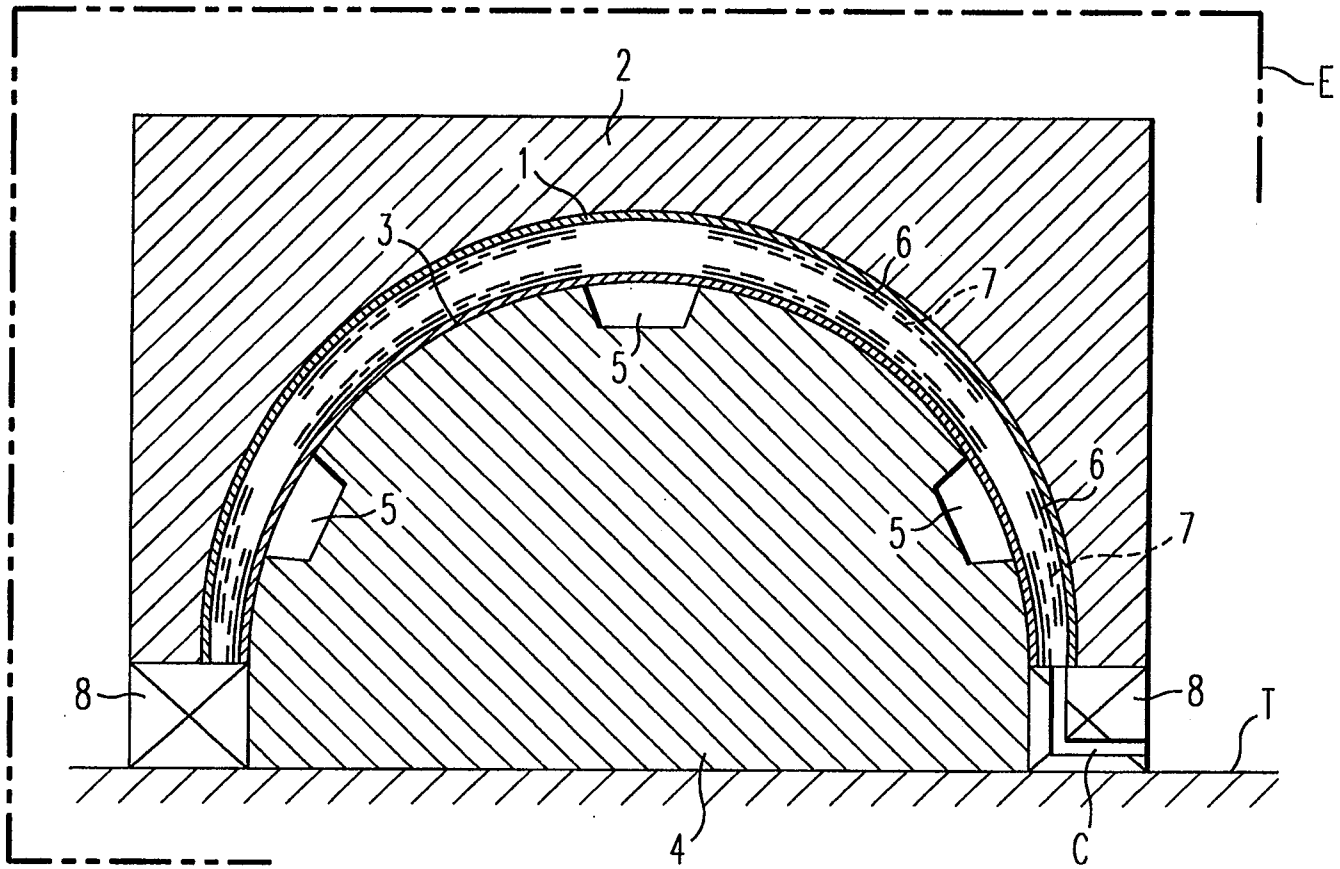
FIG. 1 is a diagrammatic view illustrating one stage of the method.

The piece to be obtained is a component of an engine cowling in the form of a portion of a cylinder or cone.

An outer alumunium sheet 1 is arranged over a concave surface of an upper die 2, and a lower sheet 3 of the same type is arranged on the convex surface of a lower header 4 which has grooves or cavities 5 corresponding to the shape of ribs to be formed on the lower sheet 3. The sheets have previously been degreased and pickled, and a thin primer-layer of adhesive receptive material 6 (a few micrometres thickness is sufficient), followed by a layer of adhesive material 7 (a few tens of micrometres thick), applied to the surface portions of each sheet 1 and 3 to be bonded (that is, to the portions which are not facing the grooves 5). The holding material 6 may be a thermosetting material or a thermostable material of the polyimide type, and the adhesive material 7 may be a polyetheretherketone (PEEK) or, more generally, a thermoplastic material. A simple method of avoiding covering certain portions of the sheets 1 and 3 consists of masking these portions by a flexible foil which is subsequently removed.

The next stage consists of the hot-forming or forging of the sheets, in this embodiment this being only the lower sheet 3. The press members 2 and 4 are held apart by spacers 8 which hold up the upper die 2. The spacers 8 consist of blocks which are placed on the same table T as the lower header 4 and extend along the joint lines.

Figure 2:
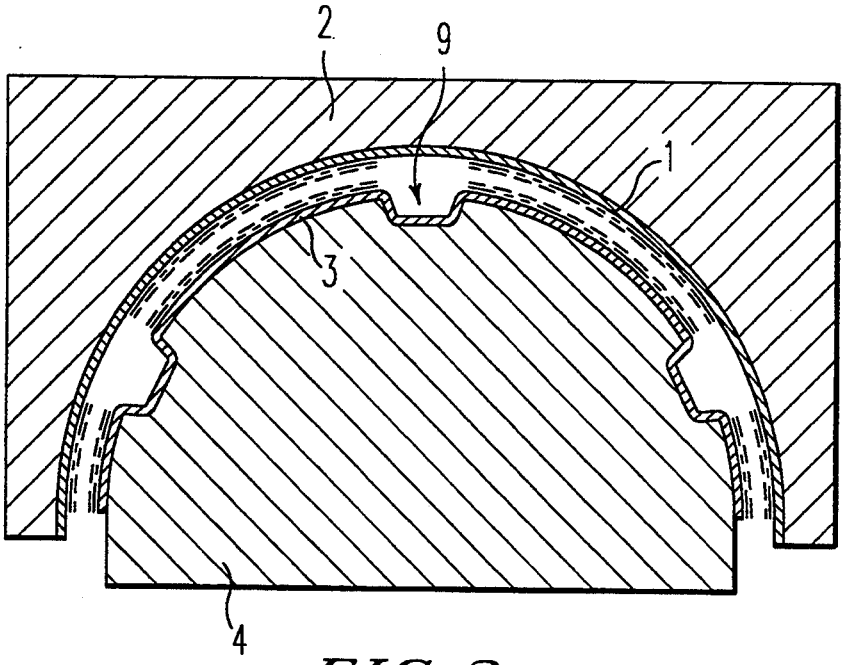
FIG. 2 is a view similar to FIG. 1 but illustrating a later stage of the method.

The members 2 and 4 are enclosed in a sealed chamber E which is then subjected to sufficient pressure to ensure that the portions of the sheets 1 and 3 which are not supported by the surfaces of the members 2 and 4 are deformed. In this embodiment the portions of the inner sheet 3 overlying the grooves 5 are deformed by plastic or superplastic flow of the metal of the inner sheet 3 to the bottom of the grooves 5 shown in FIG. 2, thereby forming ribs 9 in the sheet 3. During this step the lateral faces, not shown, of the members 2 and 4 are covered by panels carrying a flat sealing strip which allows the space in the grooves 5 between the lower sheet 3 and the lower header 4 to be isolated and thus not be subjected to pressure. Communication between the sheets 3 and 4 and the pressurized interior of the chamber E is established by a conduit C drilled in a spacer 8.

The assembly is heated to permit satisfactory plastic deformation. A temperature of 350° to 400° C. with an effective pressure of 0.6 to 1.5 bars may be sufficient in a particular case. Relatively low temperatures are sufficient when the deformation required is relatively low, as is the case in this embodiment, and when it is unnecessary to heat to conditions of the highest superplasticity. Of course, the adhesive layer 7 and the primer-layer 6 must not be destroyed by the heating, but this condition depends on the materials constituting them and it is possible to satisfy this fairly easily in practice. The primer-layer 6 may, in any case, often be omitted.

Figure 3:
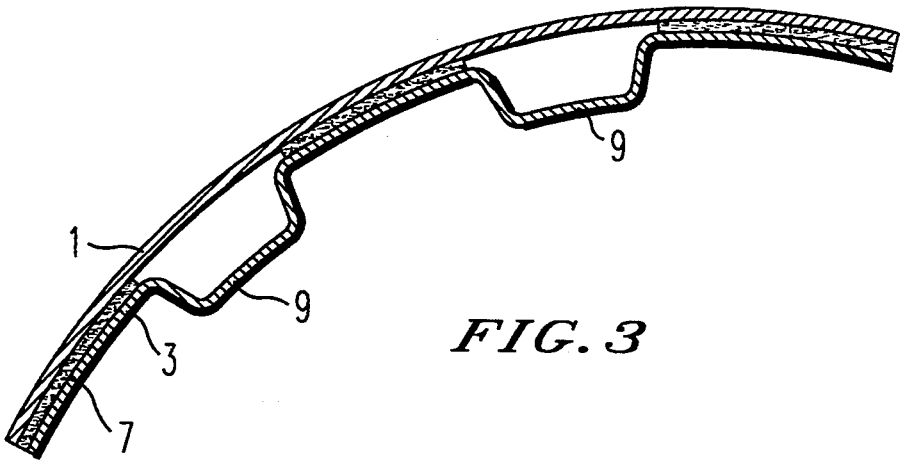
FIG. 3 is a sectional view showing a portion of an assembly obtained by the method.

The final stage starts with the removal of the spacers 8 such that the upper mold 2 falls onto the lower header 4 and the adhesive-coated surfaces of the sheets 1 and 3 come into contact. The temperature and pressure are brought to values sufficient for the material of the layer 7 to become adhesive and for the sheets 1 and 3 to be pressed sufficiently firmly against one another by the pressure exerted outside the members 2 and 4. Temperatures of 380° to 420° C. and pressures of 1 to 5 bars lead to satisfactory results in the present embodiment. The side panels can be omitted in this final stage. The tooling and the parts are then left to cool and the assembly is demolded, the sheets 1 and 2 in this assembly now forming a rigid panel, as shown in FIG. 3, having sufficient strength at the bonded joints.

It is to be noted that no handling is necessary during the method except for removing the spacers 8, and that the only other interventions involve modifying the temperature and pressure conditions inside the chamber.

Some examples of the superplasticity conditions used for the deformation stage in further embodiments of the invention are given briefly below:

for a TA6V alloy: heating to 925° C. and application of pressure of 20 bars to obtain elongations of 1000%;

for an AZ5GU alloy: heating to 510° C. and application of a pressure of 5 bars to one face of the plate and a counter-pressure of 40 bars to the opposite face in order to obtain elongations of 1000% - this embodiment therefore requiring two different sources of pressure;

for an Inconel 718 alloy: heating to 985° C. and application of a pressure of 20 bars to obtain elongations of 500%.

Obviously, numerous modifications and variations of the present invention are possible in light of the above teachings. It is therefore to be understood that within the scope of the appended claims, the invention may be practiced otherwise than as specifically described herein.

We claim:

1. A method of manufacturing an assembly composed of two bonded parts, which comprises:

providing a press having two members defining a header and a die which are movable towards and away from each other, at least one of said press members having cavities for shaping one of said parts;

placing said two parts from which said assembly is to be formed on said press members, one part on said header and the other part on said die;

placing a layer of adhesive on at least a portion of the surface of at least one of said two parts facing the other part;

applying pressure between said head and said die such that said part on said at least one member having said cavities is deformed into said cavities to shape said part; and moving said header and said die towards each other to press said two parts against each other such that said parts are bonded together by said adhesive, wherein said applying of pressure comprises a superplastic forming operation and said parts comprise metal sheets which form a cowling.

2. A method according to claim 1, wherein, during said applying of pressure, said pressure is applied between said header and said die at a temperature creating superplasticity conditions for hot-forming said parts to the shape of said header and said die.

3. A method according to claim 1, wherein said assembly comprises a rigid panel.

4. A method according to claim 1, wherein said parts comprise alumunium alloy.

5. A method according to claim 1, wherein said adhesive comprises a thermoplastic material.

6. A method according to claim 1, which comprises applying to said surface portions of said parts to which said adhesive is to be applied a primer-layer for holding the adhesive layer.

* * * * *